US005307959A

United States Patent [19]

Bedore et al.

[11] Patent Number: 5,307,959

[45] Date of Patent: May 3, 1994

[54] SPRAY CAN CONTROL APPARATUS

[76] Inventors: Robert J. Bedore; Roma N. Bedore, both of 2016 Hill, Saginaw, Mich. 48602

[21] Appl. No.: 59,066

[22] Filed: May 10, 1993

[51] Int. Cl.[5] ..... B67D 5/64

[52] U.S. Cl. ..... 222/174; 222/192; 222/474

[58] Field of Search ..... 222/174, 473, 474, 509, 222/192; 401/193, 137; 425/85

[56] References Cited

U.S. PATENT DOCUMENTS

| | | | |
|---|---|---|---|
| 3,448,722 | 6/1969 | Krizman | 401/193 X |
| 3,856,209 | 12/1974 | Hickson | 222/174 X |
| 3,861,566 | 1/1975 | Wentzell | 222/174 |
| 4,089,440 | 5/1978 | Lee | 222/174 |
| 4,319,851 | 3/1982 | Arthur | 401/137 |
| 4,789,084 | 12/1988 | Yoshitomi | 222/174 |

*Primary Examiner*—Gregory L. Huson
*Attorney, Agent, or Firm*—S. Michael Bender

[57] ABSTRACT

A new and improved spray can control apparatus includes a handle assembly, a telescopically extensible extension assembly connected to the handle assembly, and a spray can holding assembly connected to the extension assembly. A spray control actuation assembly includes a hand-operated actuator assembly supported by the handle assembly, a flexible member connected to the hand-operated actuator assembly and extending along the extension assembly, and a can nozzle actuator assembly connected to the flexible member and supported by the extension assembly. The can nozzle actuator assembly actuates a can nozzle when the hand-operated actuator assembly is actuated. The handle assembly includes a first hand-held handle member connected to the extension assembly, two strut members attached to the first hand-held handle member and projecting therefrom, and a second hand-held handle member connected to the two strut members. The first hand-held handle member, the two strut members, and the second hand-held handle member define a hand-resting area. The hand-operated actuator assembly includes a pivot connected to the handle assembly and includes an actuator member pivoted on the pivot, such that the actuator member is retained in the hand-resting area and is capable of being squeezed by fingers of a hand that grasps the second hand-held handle member.

12 Claims, 4 Drawing Sheets

SPRAY CAN CONTROL APPARATUS

BACKGROUND OF THE INVENTION

1. Field of the Invention

The present invention relates generally to devices for controlling spray cans, and more particularly, to a device especially adapted for remotely operating a spray can so the can be used to spray areas too high to be reached by person holding a spray can in a hand.

2. Description of the Prior Art

Spray cans are popular dispensers for spraying a wide variety of materials. Spray cans are widely used for dispensing paint. A building includes surfaces that need to be painted and that are too high to be reached by person holding a spray can of paint in a hand. In this respect, either a ladder must be used, or a device must be used to essentially extend the length of the person's arms to apply paint from the spray can at otherwise out of reach locations.

Many people seek to avoid the use of ladders for a number of reasons. They are expensive, they are heavy and difficult to raise and lower, and their may be dangerous. One always runs the risk of falling off of the ladder and being subjected to serious injury. In this respect, it would be desirable if a spray can control apparatus were provided that provided adequate control of a spray can at significant heights without using a ladder.

A number of devices are disclosed in the prior art which are designed to essentially extend the length of a person's arms to apply paint from the spray can at otherwise out of reach locations. For example, the following U.S. patents are known: U.S. Pat. Nos. 3,510,028; 4,023,711; 4,089,440; 4,092,000; and 4,789,084.

More specifically, the above-mentioned patents disclose and number of extension tools for aerosol dispensers. Although these devices do the basic job of effectively extending the arm of the user, with each of these devices a user would have difficulty viewing the area that is being sprayed with a straight on view. With these devices, the user would be seeing the area sprayed from below the area at a glancing or grazing angle. However, when spraying occurs, it would be desirable if the person doing the spraying could view the area being sprayed at an angle straight on or normal to the surface being sprayed. In this respect, it would be desirable if a remotely operated spray can control device were provided that permitted a user to view the surface being sprayed at an angle substantially normal or perpendicular to the surface being sprayed.

Another problem associated with the use of remotely operated spray can control devices is the lack of control over the spray can that the user has. When a user holds a can directly in the hand, movement of the hand directly controls movement of the spray can. However, when a spray can is at the end of a remotely operated spray can control device, the extension portion of the device inherent provides a leverage action such that a slight movement of the hand of the user is multiplied to become a large movement at the spray can end of the device. In this respect, it would be desirable if a remotely operated spray can control device were provided that provided improved movement control of the spray can end of the device.

In using a remotely operated spray can control device, the user must accomplish several distinct tasks with the hands. First, one must move the spray can to the proper area to be sprayed. Second, one must begin, continue, and end the spraying operation. Third, one must control movement of the can near the surface being sprayed to carry out a satisfactory spraying operation. In this respect, it is important that the handle assembly of the device be designed to facilitate the combined tasks of spray can positioning, spray control, and movement of the can during the spraying operation.

When a person holding a spray can wants to stop spraying, the user simply releases pressure on the valve actuator. However, with a remotely operated spray can control device, the device can get stuck in the spray actuation position. This result is extremely undesirable, and a remotely operated spray can control device should include design features that preclude a spray can from being stuck in the spraying mode.

Normally when a spray can is used, the can should be held a prescribed distance from the surface being sprayed. However, when a remotely operated spray can control device is employed, it is difficult, from a distance, to ascertain the prescribed distance. In this respect, it would be desirable if a remotely operated spray can control device were provided with means for maintaining the prescribed distance between the surface being sprayed and the spray can during the spraying operation.

A remotely operated spray can control device may be employed for spraying a surface that is not too far out of reach of the user; or the device may be employed for spraying a surface quite far from, and substantially out of reach from, the hands of the user. In this respect, it would be desirable if a remotely operated spray can control device were provided that had an adjustable, extensible length.

Thus, while the foregoing body of prior art indicates it to be well known to use remotely operated spray can control devices, the prior art described above does not teach or suggest a remotely operated spray can control apparatus which has the following combination of desirable features: (1) provides adequate control of a spray can at significant heights without using a ladder; (2) permits a user to view the surface being sprayed at an angle substantially normal to the surface being sprayed; (3) provides improved movement control of the spray can end of the device; (4) has a handle assembly that facilitates the combined tasks of spray can positioning, spray control, and movement of the can during the spraying operation; (5) has features that preclude a spray can from being stuck in the spraying mode; (6) has means for maintaining a prescribed distance between the surface being sprayed and the spray can during the spraying operation; and (7) has an adjustable, extensible length. The foregoing desired characteristics are provided by the unique remotely operated spray can control apparatus of the present invention as will be made apparent from the following description thereof. Other advantages of the present invention over the prior art also will be rendered evident.

SUMMARY OF THE INVENTION

To achieve the foregoing and other advantages, the present invention, briefly described, provides a new and improved spray can control apparatus which includes a handle assembly, an extension assembly connected to the handle assembly, and a spray can holding assembly connected to the extension assembly. A spray control actuation assembly includes a hand-operated actuator assembly supported by the handle assembly, a flexible member connected to the hand-operated actuator assembly and extending along the extension assembly, and a can nozzle actuator assembly connected to the flexible member and supported by the extension assembly. The can nozzle actuator assembly actuates a can nozzle when the hand-operated actuator assembly may be actuated. The handle assembly includes a first hand-held handle member connected to the extension assembly, at least one strut member attached to the first hand-held handle member and projecting therefrom, and a second hand-held handle member connected to the at least one strut member. The first hand-held handle member, the at least one strut member, and the second hand-held handle member define a hand-resting area. The hand-operated actuator assembly includes a pivot connected to the handle assembly and includes an actuator member pivoted on the pivot, such that the actuator member may be retained in the hand-resting area and may be capable of being squeezed by fingers of a hand that grasps the second hand-held handle member.

The first hand-held handle member and the second hand-held handle member may be substantially parallel to each other. The at least one strut member projects from the first hand-held handle member substantially perpendicularly from the first hand-held handle member.

The extension assembly may include a first extension member and a second extension member, and the first extension member and the second extension member may be telescopically attached to each other.

The spray can holding assembly may include a plurality of can-holding brackets connected to the extension assembly.

The can nozzle actuator assembly may include a rider member slidingly engaged with the extension assembly and may be operated by the flexible member and the hand-operated actuator assembly. A pressure-exerting member extends from the rider member and contacts an actuator button for the can nozzle, for pressing upon the actuator button to release material from the spray can. A return spring may be interposed between a bottom portion of the rider member and a portion of the extension assembly, such that the return spring lifts the pressure-exerting member off of the actuator button when the hand-operated actuator assembly is not actuated.

A spacer assembly, connected to the extension assembly, may position a spray can a predetermined distance from a surface to be sprayed. The spacer assembly may include a first spacer assembly member connected to the extension assembly and may include a space adjustment assembly connected to the first spacer assembly member and projecting from the first spacer assembly member to a surface to be sprayed. The space adjustment assembly may include a first space adjustment member connected to the first spacer assembly member and a second space adjustment member in sliding engagement with the first spacer assembly member, such that, by adjusting a position of the second space adjustment member with respect to the first spacer assembly member, an effective length of the space adjustment assembly may be adjusted to a predetermined length whereby a spray can may be positioned a predetermined distance from a surface to be sprayed.

A roller assembly may be connected to a free end of the second space adjustment member. The roller assembly may be capable of resting upon a surface to be sprayed such that the roller assembly stabilizes movement of the spray can as a spraying operation takes place.

The first spacer assembly member may include two free ends. A respective first space adjustment member may be connected to each respective free end of the first spacer assembly member. A respective second space adjustment member may be adjustably and slidingly connected to each respective first space adjustment member. A respective roller assembly may be connected to each respective second space adjustment member. Each respective roller assembly may be capable of resting upon a surface to be sprayed such that the roller assembly stabilizes movement of the spray can as a spraying operation takes place. The respective second space adjustment members, and the respective roller assemblies straddle a spray can positioned therebetween by the extension assembly.

A mirror assembly may be supported by the extension assembly at a tilt angle such that a user is capable of viewing a surface to be sprayed at a viewing angle substantially perpendicular to the surface. The mirror assembly may include a mirror unit, a mirror support member for supporting the mirror unit at a tilt angle, and a support element, connected to the extension assembly, for supporting the mirror support member and the mirror unit at a tilt angle such that a user is capable of viewing a surface to be sprayed at a viewing angle substantially perpendicular to the surface.

The above brief description sets forth rather broadly the more important features of the present invention in order that the detailed description thereof that follows may be better understood, and in order that the present contributions to the art may be better appreciated. There are, of course, additional features of the invention that will be described hereinafter and which will be for the subject matter of the claims appended hereto.

In this respect, before explaining at least three preferred embodiments of the invention in detail, it is understood that the invention is not limited in its application to the details of the construction and to the arrangements of the components set forth in the following description or illustrated in the drawings. The invention is capable of other embodiments and of being practiced and carried out in various ways. Also, it is to be understood, that the phraseology and terminology employed herein are for the purpose of description and should not be regarded as limiting.

As such, those skilled in the art will appreciate that the conception, upon which disclosure is based, may readily be utilized as a basis for designing other structures, methods, and systems for carrying out the several purposes of the present invention. It is important, therefore, that the claims be regarded as including such equivalent constructions insofar as they do not depart from the spirit and scope of the present invention.

Further, the purpose of the foregoing Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. Accordingly, the Abstract is neither intended to define the invention or the application, which only is measured by the claims, nor is it intended to be limiting as to the scope of the invention in any way.

It is therefore an object of the present invention to provide a new and improved spray can control apparatus which has all of the advantages of the prior art and none of the disadvantages.

It is another object of the present invention to provide a new and improved spray can control apparatus which may be easily and efficiently manufactured and marketed.

It is a further object of the present invention to provide a new and improved spray can control apparatus which is of durable and reliable construction.

An even further object of the present invention is to provide a new and improved spray can control apparatus which is susceptible of a low cost of manufacture with regard to both materials and labor, and which accordingly is then susceptible of low prices of sale to the consuming public, thereby making such remotely operated spray can control apparatus available to the buying public.

Still yet a further object of the present invention is to provide a new and improved spray can control apparatus which provides adequate remote control of a spray can at significant heights without using a ladder.

Still another object of the present invention is to provide a new and improved spray can control apparatus that permits a user to view the surface being sprayed at an angle substantially normal to the surface being sprayed.

Yet another object of the present invention is to provide a new and improved remote controlled spray can control apparatus which provides improved movement control of the spray can end of the device.

Even another object of the present invention is to provide a new and improved remotely operated spray can control apparatus that has a handle assembly that facilitates the combined tasks of spray can positioning, spray control, and movement of the can during the spraying operation.

Still a further object of the present invention is to provide a new and improved remotely operated spray can control apparatus which has features that preclude a spray can from being stuck in the spraying mode.

Yet another object of the present invention is to provide a new and improved remotely operated spray can control apparatus that has means for maintaining a prescribed distance between the surface being sprayed and the spray can during the spraying operation.

Still another object of the present invention is to provide a new and improved remotely operated spray can control apparatus which has an adjustable, extensible length.

These together with still other objects of the invention, along with the various features of novelty which characterize the invention, are pointed out with particularity in the claims annexed to and forming a part of this disclosure. For a better understanding of the invention, its operating advantages and the objects attained by its uses, reference should be had to the accompanying drawings and descriptive matter in which there are illustrated preferred embodiments of the invention.

BRIEF DESCRIPTION OF THE DRAWINGS

The invention will be better understood and the above objects as well as objects other than those set forth above will become more apparent after a study of the following detailed description thereof. Such description makes reference to the annexed drawing wherein.

DESCRIPTION OF THE PREFERRED EMBODIMENT

Figure 1:
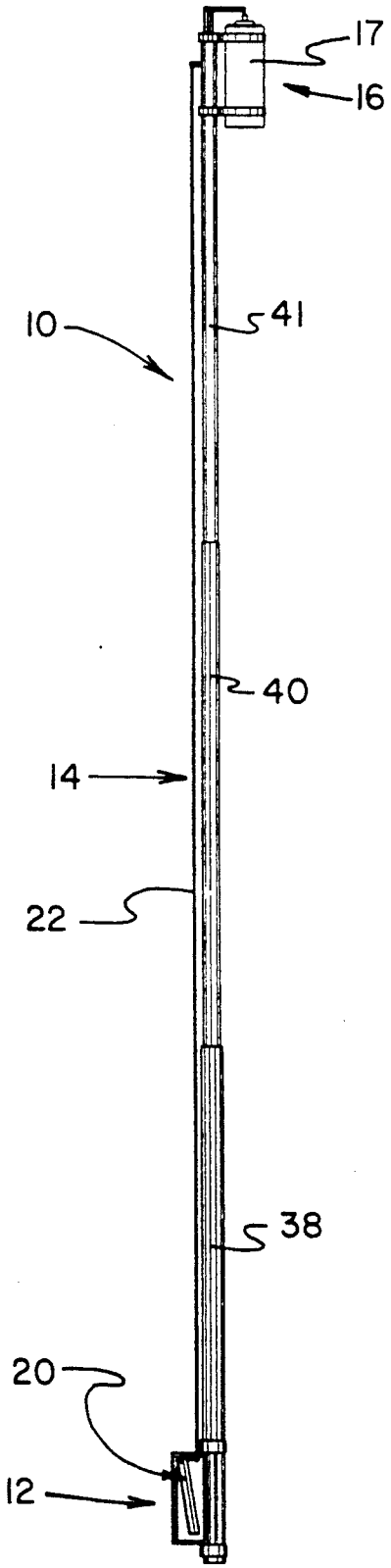
FIG. 1 is a side view showing a first preferred embodiment of the spray can control apparatus of the invention.
Figure 2:
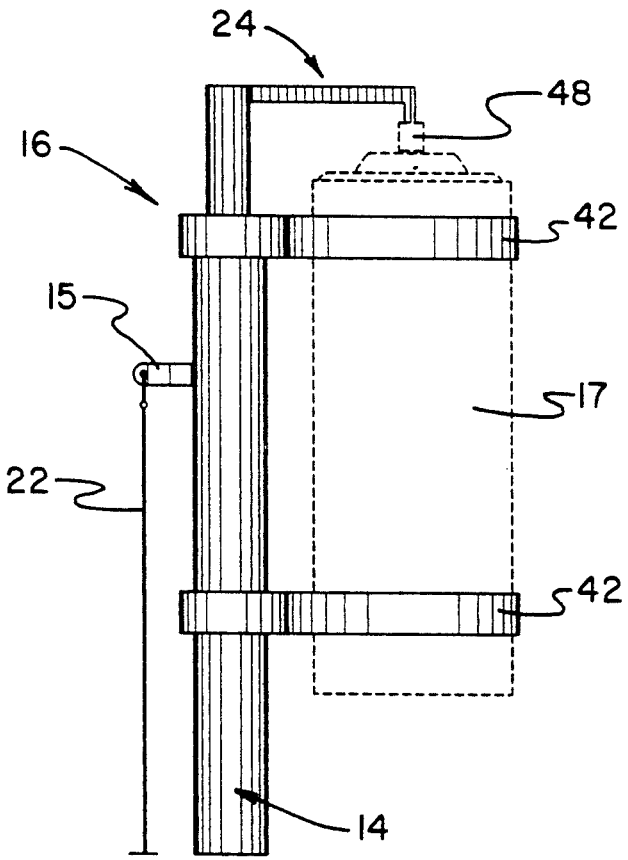
FIG. 2 is an enlarged side view of the spray can end of the embodiment of the invention shown in FIG. 1.

With reference to the drawings, a new and improved spray can control apparatus embodying the principles and concepts of the present invention will be described.

Turning initially to FIGS. 1–5, there is shown a first exemplary embodiment of the remotely operated spray can control apparatus of the invention generally designated by reference numeral 10. In its preferred form, remotely operated spray can control apparatus 10 includes a handle assembly 12, an extension assembly 14 connected to the handle assembly 12, and a spray can holding assembly 16 connected to the extension assembly 14. A spray control actuation assembly includes a hand-operated actuator assembly 20 supported by the handle assembly 12, a flexible member 22 connected to the hand-operated actuator assembly 20 and extending along the extension assembly 14, and a can nozzle actuator assembly 24 connected to the flexible member 22 and supported by the extension assembly 14. The can nozzle actuator assembly 24 actuates an actuator button 48 for the can nozzle when the hand-operated actuator assembly 20 is actuated. The spray can is designated as element 17.

Figure 3:
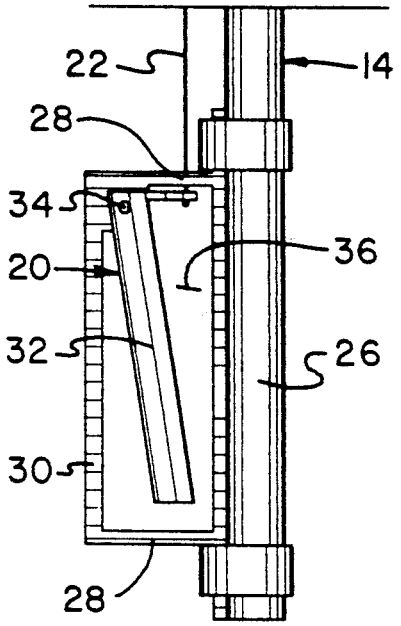
FIG. 3 is an enlarged side view of handle end of the embodiment of the invention shown in FIG. 1 in the non-spraying position.
Figure 4:
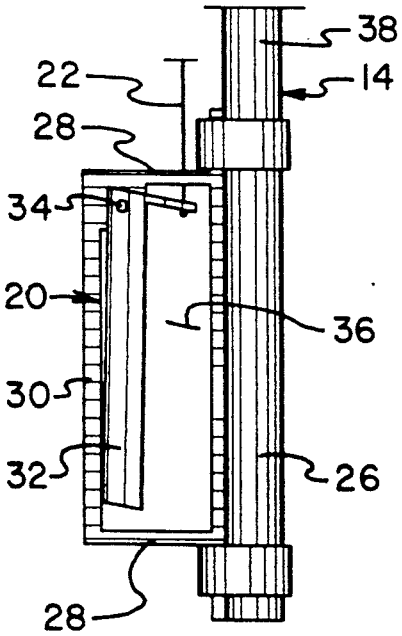
FIG. 4 is an enlarged side view of handle end of the embodiment of the invention shown in FIG. 1 in the spraying position.

The handle assembly 12 includes a first hand-held handle member 26 connected to the extension assembly 14, at least one strut member 28 attached to the first hand-held handle member 26 and projecting therefrom, and a second hand-held handle member 30 connected to the at least one strut member 28. The first hand-held handle member 26, the at least one strut member 28, and the second hand-held handle member 30 define a hand-resting area 36. The hand-operated actuator assembly 20 includes a pivot 34 connected to the handle assembly 12 and includes an actuator member 32 pivoted on the pivot 34, such that the actuator member 32 is retained in the hand-resting area 36 and is capable of being squeezed by fingers of a hand that grasps the second hand-held handle member 30. FIG. 3 shows the position of the actuator member 32 in an ungrasped position such that the can nozzle is not actuated. FIG. 4 shows the position of the actuator member 32 in a grasped position such that the can nozzle is actuated.

The first hand-held handle member 26 and the second hand-held handle member 30 are substantially parallel to each other. Two strut members 28 project from the first hand-held handle member 26 substantially perpendicularly from the first hand-held handle member 26.

The extension assembly 14 includes a first extension member 38, a second extension member 40, and a third extension member 41. The first, second, and third extension membersare telescopically attached to each other.

The spray can holding assembly 16 includes a plurality of can-holding brackets 42 connected to the extension assembly 14.

Figure 5:
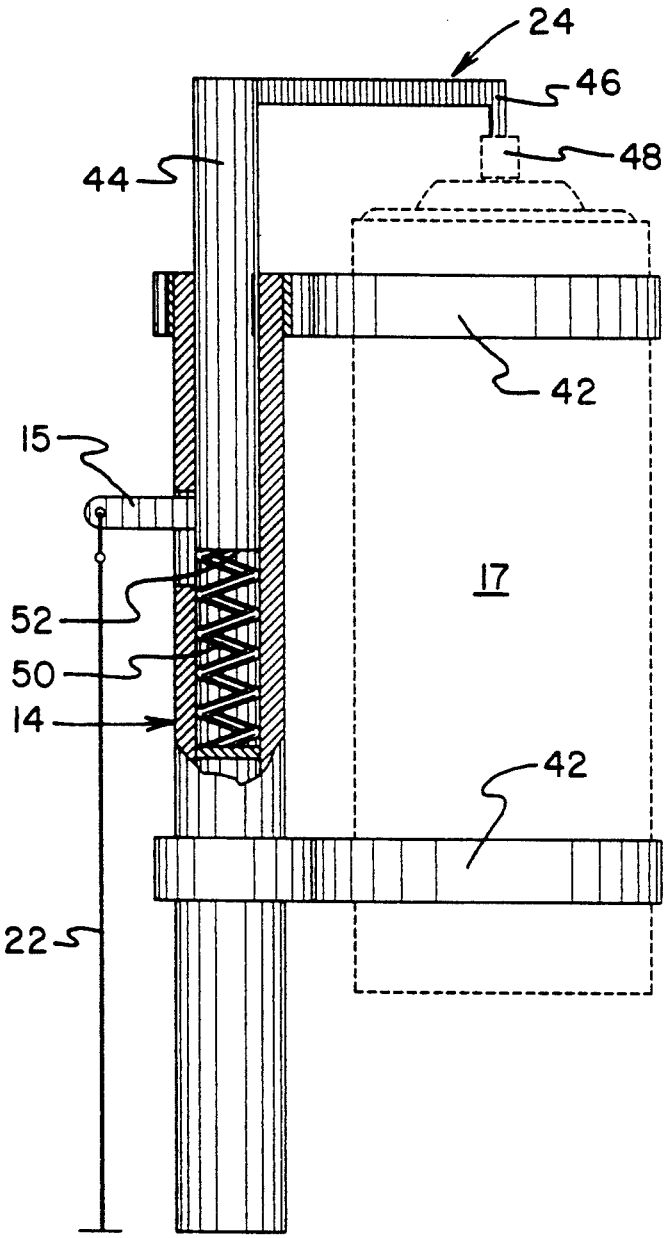
FIG. 5 is an enlarged side view, in partial cross-section, of the spray can end of the embodiment of the invention shown in FIG. 1 in the non-spraying position.

As shown most clearly in FIG. 5, the can nozzle actuator assembly 24 includes a rider member 44 slidingly engaged with the extension assembly 14 and is operated by the flexible member 22 and the hand-operated actuator assembly 20. A pressure-exerting member 46 extends from the rider member 44 and contacts an actuator button 48 for the can nozzle, for pressing upon the actuator button 48 to release material from the spray can 17. A return spring 50 is interposed between a bottom portion 52 of the rider member 44 and a portion of the extension assembly 14, such that the return spring 50 lifts the pressure-exerting member 46 off of the actuator button 48 when the hand-operated actuator assembly 20 is not actuated. The rider member 44 is pulled down by short rider arm 15 that is connected to flexible member 22 of the hand-operated actuator assembly.

Figure 6:
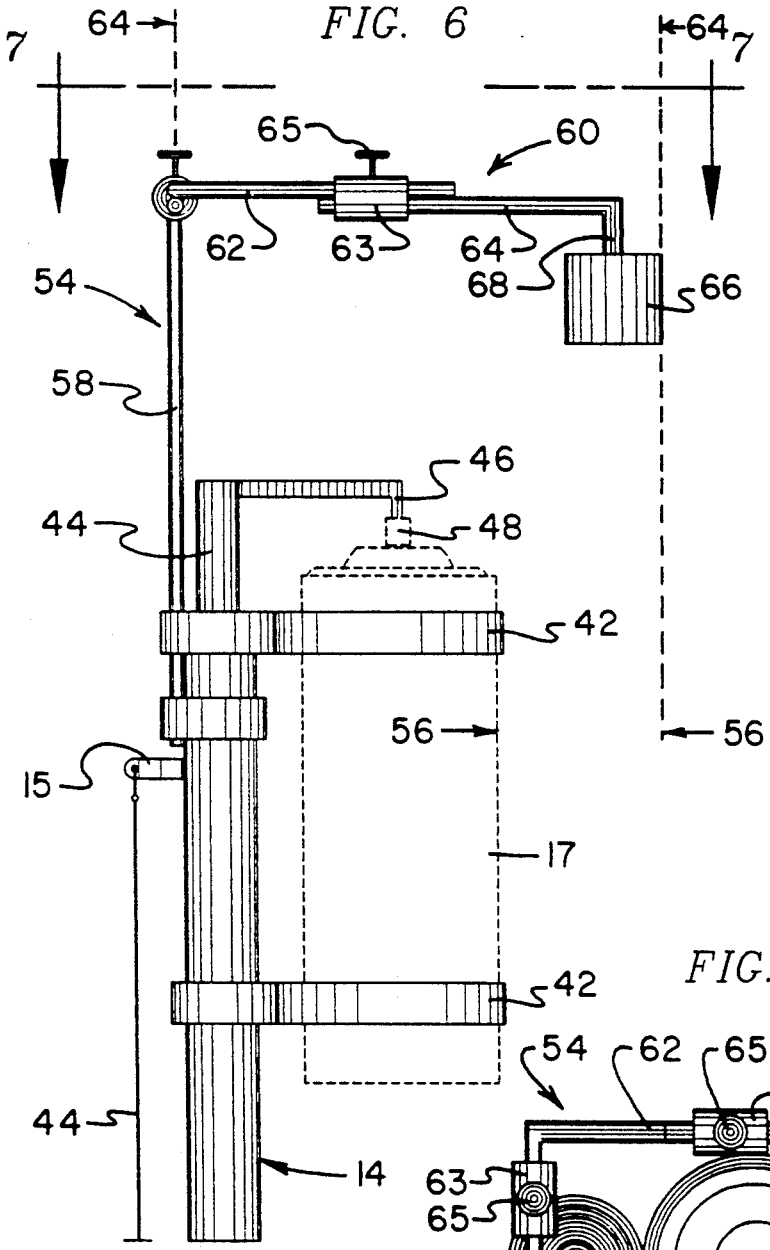
FIG. 6 is a side view of the top portion of a second embodiment of the spray can control apparatus of the invention showing rollers for controlling movement of the apparatus during spraying.
Figure 7:
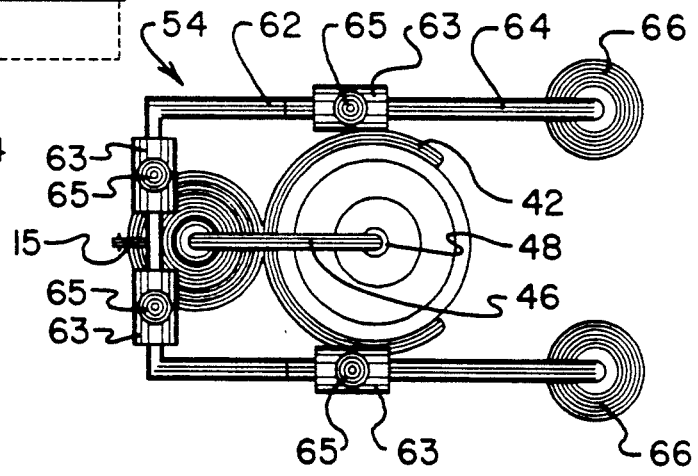
FIG. 7 is a top view of the embodiment shown in FIG. 6 taken along the line 7—7 thereof.

Turning to FIGS. 6–7, a second embodiment of the invention is shown. Reference numerals are shown that correspond to like reference numerals that designate like elements shown in other figures. In addition, a spacer assembly 54, connected to the extension assembly 14, positions a spray can 17 a predetermined distance 56 from a surface to be sprayed. The spacer assembly 54 includes a first spacer assembly member 58 connected to the extension assembly 14 and includes a space adjustment assembly 60 connected to the first spacer assembly member 58 and projecting from the first spacer assembly member 58 to a surface to be sprayed. The space adjustment assembly 60 includes a first space adjustment member 62 connected to the first spacer assembly member 58 and a second space adjustment member 64 in sliding engagement with the first spacer assembly member 58, such that, by adjusting a position of the second space adjustment member 64 with respect to the first spacer assembly member 58, an effective length of the spacer adjustment assembly 60 is adjusted to a predetermined length 64 whereby a spray can 17 is positioned a predetermined distance 56 from a surface to be sprayed. A sleeve 63 and a lockout 65 are used to secure the first space adjustment member 62 and the second space adjustment member 64 together. Similarly, a sleeve 63 and lockout 65 are used to secure the first space adjustment member 62 to the first spacer assembly member 58.

A roller assembly 66 is connected to a free end 68 of the second space adjustment member 64. The roller assembly 66 is capable of resting upon a surface to be sprayed such that the roller assembly 66 stabilizes movement of the spray can 17 as a spraying operation takes place.

The first spacer assembly member 58 includes two free ends. A respective first space adjustment member 62 is connected to each respective free end of the first spacer assembly member 58. A respective second space adjustment member 64 is adjustably and slidingly connected to each respective first space adjustment member 62. A respective roller assembly 66 is connected to each respective second space adjustment member 64. Each respective roller assembly 66 is capable of resting upon a surface to be sprayed such that the roller assembly 66 stabilizes movement of the spray can 17 as a spraying operation takes place. The respective second space adjustment members 64, and the respective roller assemblies 66 straddle a spray can 17 positioned therebetween by the extension assembly 14.

Figure 8:
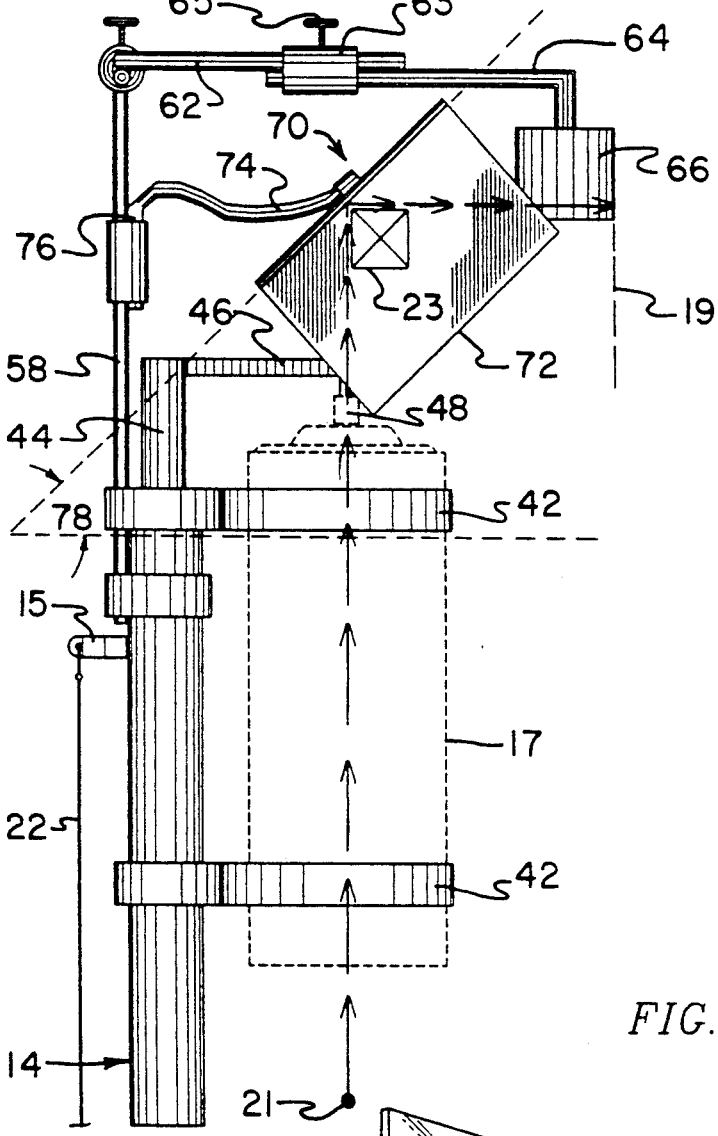
FIG. 8 is a side view of the top portion of a third embodiment of the spray can control apparatus of the invention showing a mirror for obtaining a substantially perpendicular view of the surface being sprayed.
Figure 9:
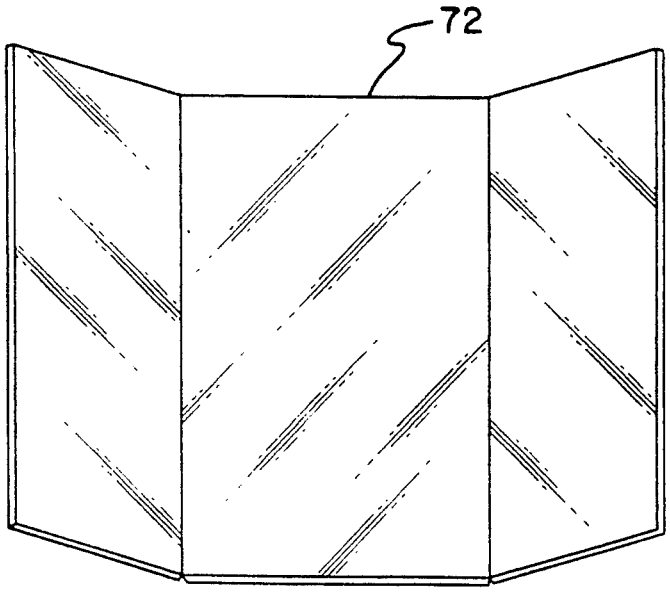
FIG. 9 is a front view of the mirror shown in FIG. 8.

Turning to FIGS. 8–9, a third embodiment of the invention is shown. Reference numerals are shown that correspond to like reference numerals that designate like elements shown in the other figures. In addition, a mirror assembly 70 is supported by the extension assembly 14 at a tilt angle 78 such that a user is capable of viewing a surface 19 that is sprayed at an angle substantially perpendicular to the surface. A right angle 23 is present between the vantage point of a user, designated as point 21, and the surface 19 that is being sprayed. Lines of arrows show the arrangement of the view of the surface 19 seen by a user from vantage point 21. The mirror assembly 70 includes a mirror unit 72, a mirror support member 74 for supporting the mirror unit 72 at a tilt angle 78, and a support element 76, connected to the extension assembly 14, for supporting the mirror support member 74 and the mirror unit 72 at a tilt angle 78 such that a user is capable of viewing a surface that is sprayed at an angle substantially perpendicular to the surface. In FIG. 8, the mirror support member 74 is connected to the first spacer assembly member 58 which is connected to the extension assembly 14.

The components of the remotely operated spray can control apparatus of the invention can be made from inexpensive and durable metal or plastic materials.

It is apparent from the above that the present invention accomplishes all of the objects set forth by providing a new and improved remotely operated spray can control apparatus that is low in cost, relatively simple in design and operation, and which may advantageously be used to provide adequate control of a spray can at significant heights without using a ladder. With the invention, a remotely operated spray can control apparatus is provided which permits a user to view the surface being sprayed at an angle substantially normal to the surface being sprayed. With the invention, a remotely operated spray can control apparatus is provided which provides improved movement control of the spray can end of the device. With the invention, a remotely operated spray can control apparatus is provided which has a handle assembly that facilitates the combined tasks of spray can positioning, spray control, and movement of the can during the spraying operation. With the invention, a remotely operated spray can control apparatus is provided which has features that preclude a spray can from being stuck in the spraying mode. With the invention, a remotely operated spray can control apparatus is provided which has means for maintaining a prescribed distance between the surface being sprayed and the spray can during the spraying operation. With the invention, a remotely operated spray can control apparatus is provided which has an adjustable, extensible length.

With respect to the above description, it should be realized that the optimum dimensional relationships for the parts of the invention, to include variations in size, form function and manner of operation, assembly and use, are deemed readily apparent and obvious to those skilled in the art, and therefore, all relationships equivalent to those illustrated in the drawings and described in the specification are intended to be encompassed only by the scope of appended claims.

While the present invention has been shown in the drawings and fully described above with particularity and detail in connection with what is presently deemed to be the most practical and preferred embodiments of the invention, it will be apparent to those of ordinary skill in the art that many modifications thereof may be made without departing from the principles and concepts set forth herein. Hence, the proper scope of the present invention should be determined only by the broadest interpretation of the appended claims so as to encompass all such modifications and equivalents.

What is claimed as being new and desired to be protected by Letters Patent of the United States is as follows:

1. A new and improved spray can control apparatus, comprising:

a handle assembly, an extension assembly connected to said handle assembly, a spray can holding assembly connected to said extension assembly, and a spray control actuation assembly comprised of a hand-operated actuator assembly supported by said handle assembly, a flexible member connected to said hand-operated actuator assembly and extending along said extension assembly, and a can nozzle actuator assembly connected to said flexible member and supported by said extension assembly for actuating a can nozzle when said hand-operated actuator assembly is actuated, wherein said handle assembly includes a first hand-held handle member connected to said extension assembly, at least one strut member attached to said first hand-held handle member and projecting therefrom, and a second hand-held handle member connected to said at least one strut member, said first hand-held handle member, said at least one strut member, and said second hand-held handle member defining a hand-resting area, wherein said hand-operated actuator assembly includes a pivot connected to said handle assembly and an actuator member pivoted on said pivot, such that said actuator member is retained in said hand-resting area and is capable of being squeezed by fingers of a hand that grasps said second hand-held handle member, further including:

a spacer assembly, connected to said extension assembly, for positioning a spray can a predetermined distance from a surface to be sprayed, said spacer assembly including means for adjusting the position thereof relative to said extension assembly to selectively vary said predetermined distance.

2. The apparatus described in claim 1 wherein said first hand-held handle member and said second hand-held handle member are substantially parallel to each other.

3. The apparatus described in claim 1 wherein said at least one strut member projects from said first hand-held handle member substantially perpendicularly from said first hand-held handle member.

4. The apparatus described in claim 1 wherein:

said extension assembly includes a first extension member and a second extension member, and said first extension member and said second extension member are telescopically attached to each other.

5. The apparatus described in claim 1 wherein said spray can holding assembly includes a plurality of can-holding brackets connected to said extension assembly.

6. The apparatus described in claim 1 wherein said can nozzle actuator assembly includes:

a rider member slidingly engaged with said extension assembly and operated by said flexible member and said hand-operated actuator assembly, a pressure-exerting member, extending from said rider member and contacting an actuator button for the can nozzle, for pressing upon the actuator button to release material from the spray can, and a return spring interposed between a bottom portion of said rider member and a portion of said extension assembly, such that said return spring lifts said pressure-exerting member off of the actuator button when said hand-operated actuator assembly is not being actuated.

7. The apparatus described in claim 1 wherein said spacer assembly includes:

a first spacer assembly member connected to said extension assembly, and said means for adjusting comprises a space adjustment assembly connected to said first spacer assembly member and projecting from said first spacer assembly member to a surface to be sprayed.

8. The apparatus described in claim 7 wherein said space adjustment assembly includes a first space adjustment member connected to said first spacer assembly member and a second space adjustment member in sliding engagement with said first spacer assembly member, such that, by adjusting a position of said second space adjustment member with respect to said first spacer assembly member, an effective length of said space adjustment assembly is adjusted to a predetermined length whereby a spray can is positioned a predetermined distance from a surface to be sprayed.

9. The apparatus described in claim 8, further including:

a roller assembly connected to a free end of said second space adjustment member, said roller assembly capable of resting upon a surface to be sprayed such that said roller assembly stabilizes movement of the spray can as a spraying operation takes place.

10. A new and improved spray can control apparatus, comprising:

a handle assembly, an extension assembly connected to said handle assembly, a spray can holding assembly connected to said extension assembly, and a spray control actuation assembly comprised of a hand-operated actuator assembly supported by said handle assembly, a flexible member connected to said hand-operated actuator assembly and extending along said extension assembly, and a can nozzle actuator assembly connected to said flexible member and supported by said extension assembly for actuating a can nozzle when said hand-operated actuator assembly is actuated.

wherein said handle assembly includes a first hand-held handle member connected to said extension assembly, at least one strut member attached to said first hand-held handle member and projecting therefrom, and a second hand-held handle member connected to said at least one strut member, said first hand-held handle member, said at least one strut member, and said second hand-held handle member defining a hand-resting area, wherein said hand-operated actuator assembly includes a pivot connected to said handle assembly and an actuator member pivoted on said pivot, such that said actuator member is retained in said hand-resting area and is capable of being squeezed by fingers of a hand that grasps said second hand-held handle member, further including:

a spacer assembly, connected to said extension assembly, for positioning a spray can a predetermined distance from a surface to be sprayed, wherein:

said spacer assembly member includes two free ends, a respective first space adjustment member is connected to each respective free end of said first spacer assembly member, a respective second space adjustment member is adjustably and slidingly connected to each respective first space adjustment member, a respective roller assembly is connected to each respective second space adjustment member, each said roller assembly capable of resting upon a surface to be sprayed such that said roller assembly stabilizes movement of the spray can as a spraying operation takes place, and said respective first space adjustment members, said respective second space adjustment members, and said respective roller assemblies straddle a spray can positioned therebetween by said extension assembly.

11. The apparatus described in claim 1, further including:

a mirror assembly, supported by said extension assembly at a tilt angle such that a user is capable of viewing a surface being sprayed at an angle substantially perpendicular to the surface.

12. The apparatus described in claim 11 wherein said mirror assembly includes:

a mirror unit, a mirror support member for supporting said mirror unit at a tilt angle, and support means, connected to said extension assembly, for supporting said mirror support member and said mirror unit such that a user is capable of viewing a surface being sprayed at an angle substantially perpendicular to the surface.

* * * * *